US005105916A

United States Patent [19]

Steacy et al.

[11] Patent Number: 5,105,916

[45] Date of Patent: Apr. 21, 1992

[54] ELEVATOR DOOR COUPLING DEVICE

[75] Inventors: Robert J. Steacy, Collinsville; John C. Chang, Cheshire, both of Conn.

[73] Assignee: Otis Elevator Company

[21] Appl. No.: 607,437

[22] Filed: Oct. 31, 1990

[51] Int. Cl.[5] ..... B66B 13/00

[52] U.S. Cl. ..... 187/52 LC; 157/61

[58] Field of Search ..... 187/52 LC, 52 R, 56, 187/57, 61; 49/118, 120, 103

[56] References Cited

U.S. PATENT DOCUMENTS 2,432,293 12/1947 Giovanni ..... 187/52 LC 3,638,762 2/1972 Johns ..... 187/52 LC

*Primary Examiner*—D. Glenn Dayoan

*Assistant Examiner*—Kenneth Noland

*Attorney, Agent, or Firm*—Lloyd D. Doigan

[57] ABSTRACT

A linkage is provided for joining a car door to a hoistway door, the linkage having a lever attached about a middle portion thereof to one of the car or hoistway doors, the lever having a roller disposed at an end portion thereof for fixedly engaging the other of the car or hoistway doors, the lever cooperating with a linkage connected to the door operating unit to allow the rollers to engage the other of the car or hoistway doors without moving the other of the car or hoistway doors. A latch cooperates with a linkage connected to the door operating unit to allow the car doors to close without disengaging the rollers from the vane and for allowing the rollers to disengage the vane after the doors are closed.

2 Claims, 3 Drawing Sheets

ELEVATOR DOOR COUPLING DEVICE

TECHNICAL FIELD

This device relates to elevator doors having inner and outer doors, and more particularly to a device for coupling the inner and outer doors.

BACKGROUND ART

Center opening elevator doors systems consist of a pair of car doors and a pair of hoistway doors. Each pair of doors opens and closes about a central point in an elevator doorway.

A door operating unit, disposed atop an elevator car, is attached to each car door via a four bar linkage. Each car door, in turn, is coupled by a pair of linked rollers to a vane attaching to the hoistway doors.

As each car door opens or closes, driven by the door operating unit via the four bar linkage, a first of the linked rollers engages the vane. Typically, contact with the vane by the first roller urges the second roller into contact with the vane as the car door moves thereby locking the vane between the two rollers. When both rollers engage the vane, the hoistway door starts to move with the car door. Because the car door starts to move before the hoistway doors, the car door leading edge is offset from the hoistway door leading edge during portions of the travel of the doors. As a result, the door operating unit must provide force to accelerate the car door and then provide an additional force to accelerate the attached hoistway door. The additional force may result in noisy door operation unless the motion of both doors is accurately controlled both in speed and distance.

DISCLOSURE OF THE INVENTION

It is an object of the invention to provide simultaneous motion of the car doors and the hoistway doors throughout the travel of both doors.

It is a further object of the invention to provide quiet coupling of the hoistway and car doors.

It is a further object of the invention to provide a single accelerating position for both doors.

According to the invention, a linkage is provided for joining a car door to a hoistway door, the linkage having a lever attached about a middle portion thereof to one of the car or hoistway doors, the lever having a roller (or other means) disposed at each end portions thereof for fixedly engaging the other of the car or hoistway doors, the lever cooperating with a linkage connected to the door operating unit to allow rollers to engage the other of the car or hoistway doors without moving the other of the car or hoistway doors.

According further to the invention, a latch cooperates with a linkage connected to the door operating unit to allow the car doors to close without disengaging the rollers from the vane and for allowing the rollers to disengage the vane after the doors are closed.

According further to the invention, the door operating unit is provided with a lever arm which moves simultaneously with the motion thereof to unlock the hoistway doors as the door operating unit starts to provide motive force and to lock the hoistway doors after the hoistway doors are closed.

By coupling the doors prior to acceleration of either door, a single acceleration point is provided. Door operation is quieter as a result. Moreover, the leading edges of the car and respective hoistway doors are in register throughout the stroke of the doors.

These and other objects, features, and advantages of the present invention will become more apparent in light of the following detailed description of a best mode embodiment thereof, as illustrated in the accompanying drawing.

BEST MODE FOR CARRYING OUT THE INVENTION

Figure 1:
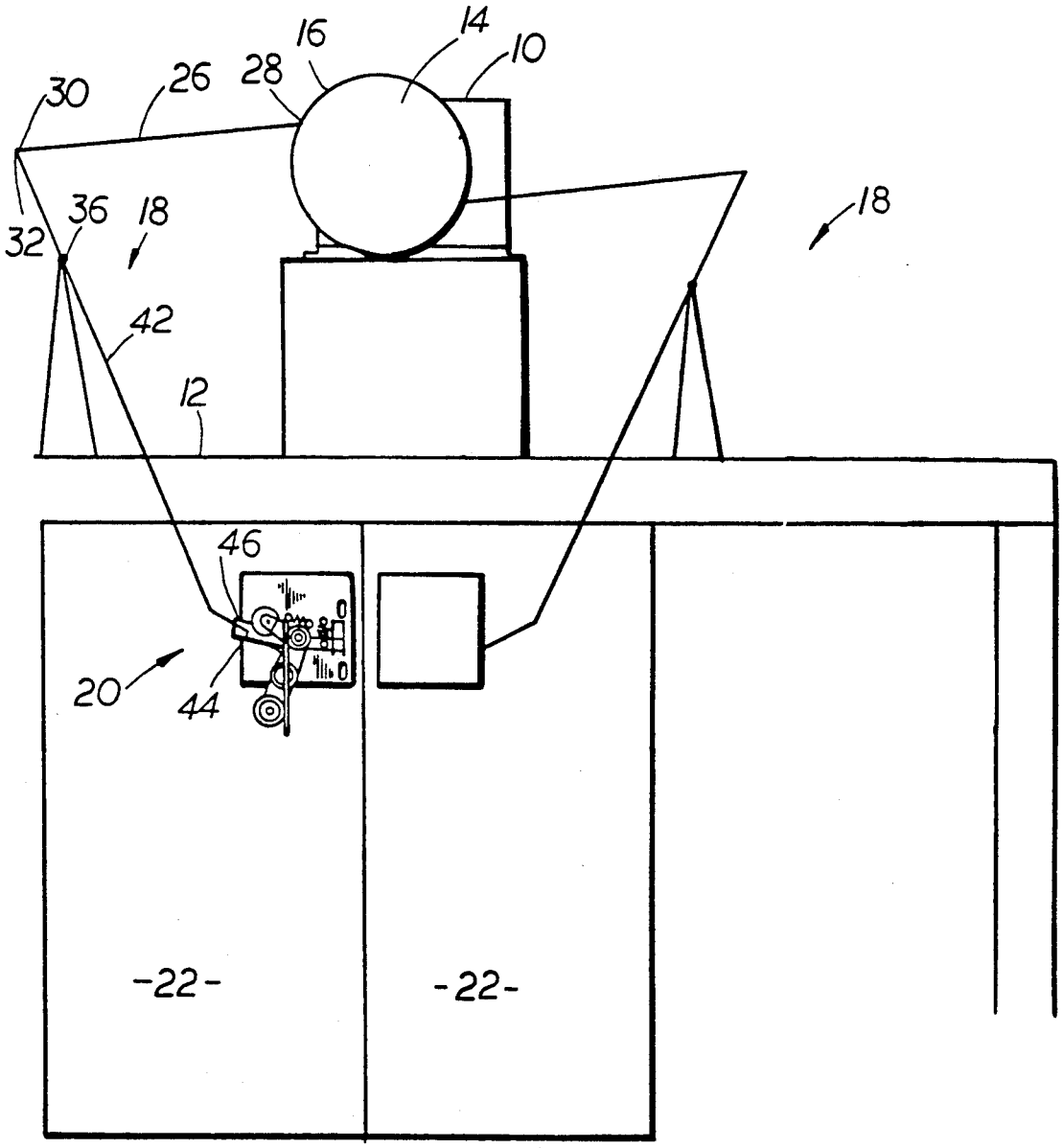
FIG. 1 shows a plan view, partly in perspective, and partly in schematic form, of an elevator door system embodying the invention.

Referring to FIG. 1, an embodiment of the invention is shown. A bi-directional door operating unit 10 is mounted, by conventional means, atop an elevator car 12. The door operating unit has an output sheave 14 which is attached at its outer periphery 16 thereof to a pair of linkages 18. Each linkage attaches by means of a coupling device 20 to a car door 22 and to a vane 24 (see FIGS. 2-5) which is connected to a hoistway door (not shown).

The linkages 18 attaching to the output sheave 14 of the door operating unit 10 are well known in the art. A first link 26 attaches rotatably at a first end portion 28 to the periphery 16 of the output sheave and at a second end portion 30 thereof to a first end portion 32 of a second link 42. The second link rotates about an axis 36 which is supported conventionally (shown schematically) atop the elevator car 12. A second end portion 44 of the second link is rotatably attached to the first end portion 46 of a third link 48 (see FIG. 5).

Referring now to FIGS. 2-5, the coupling device 20 is described in detail. The coupling device consists of a plate 50 for mounting the coupling to the car door 22, a cam 52, a latch plate 54, a latch 56, and a lever 58.

The cam 52 has a triangular shape and attaches by means of screws or bolts 60, or the like, to the second end portion 44 of the second link 42. The cam has a camming surface 62.

The latch plate 54 has a first arm 64 having a first roller 66 mounted thereto for engaging the camming surface 62, and a second arm 68 offset from the first arm by a given angle for engaging the latch 56 as will be discussed infra. The latch plate has a mid-portion 70 joining the first and second arms, the mid-portion being rotatably mounted about a first axle 72 disposed in a first end portion 74 of the lever 58.

The latch 56 is fixedly attached, by conventional means to the plate 50. The latch extends outwardly from the mounting plate to engage the second arm 68 of the latching plate 54 and has a protrusion 76 for preventing over-rotation of the second arm.

The third link 48, as noted above, has a first end portion 46 which is rotatably attached to the second end portion 44 of the second link 42. A second end portion 78 of the third link is rotatably attached to the first axle 72 disposed in the first end portion 74 of the lever 58.

The lever 58 attaches by a second axle 80 to the mounting plate. A second roller 82 is mounted to the first end portion of the lever. A third roller 84 is pivotally mounted upon a third axle 86 mounted within a second end portion 88 of the lever. The rollers are positioned on the lever and the lever is mounted upon the axle so that the rollers grip the vane simultaneously.

A first spring 90 attaches the first end portion 74 of the lever 58 to the plate 50. A second spring 92 attaches the second leg 68 of the latch plate 54 to the plate 50. The second spring 92 urges the first roller into contact with the cam surface. The second spring also tends to maintain the second leg 68 of the latch plate in contact with the latch 56 and its protrusion 76. The first spring 90 urges the rollers into contact with the vane during the opening of the doors and tends to keep the car doors 22 closed.

Figure 2:
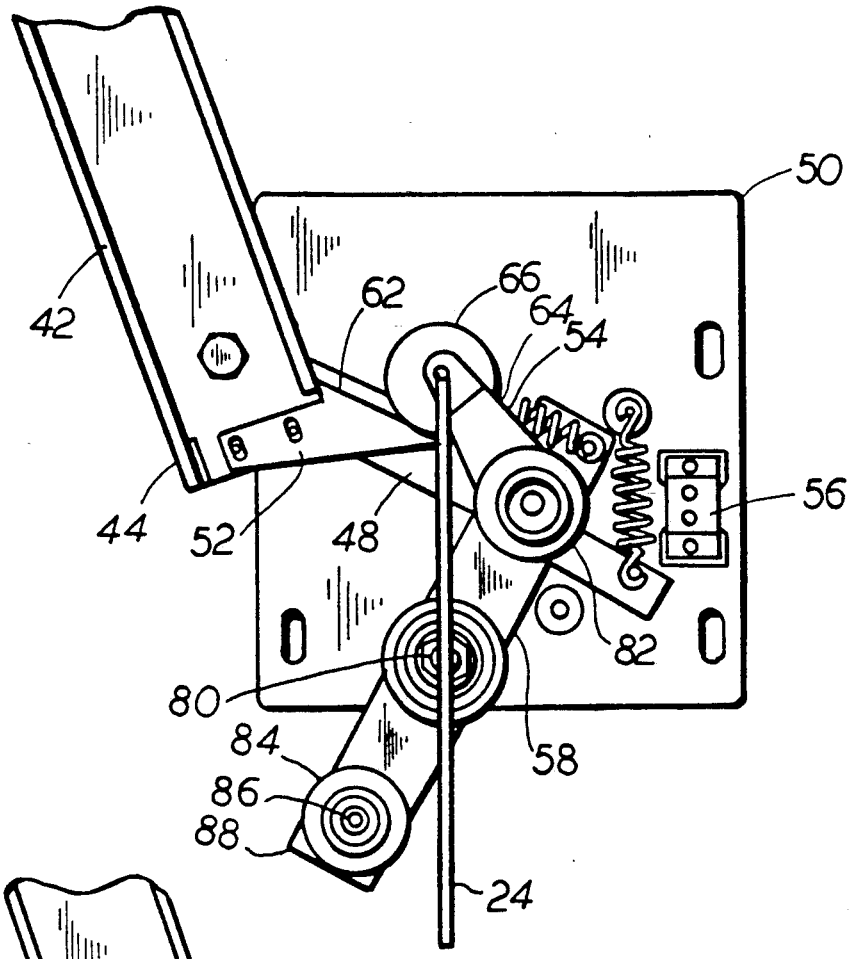
FIG. 2 shows a car and hoistway door coupling device of FIG. 1 in a first position.
Figure 3:
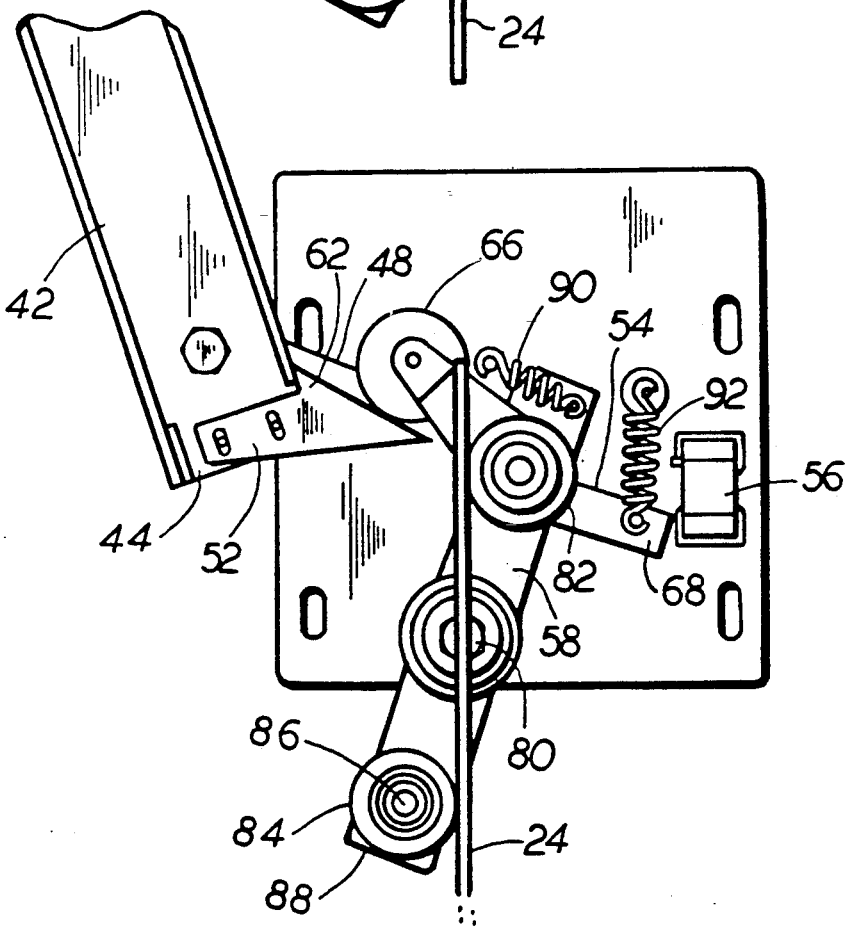
FIG. 3 shows a car and hoistway door coupling device of FIG. 1 in a second position.
Figure 4:
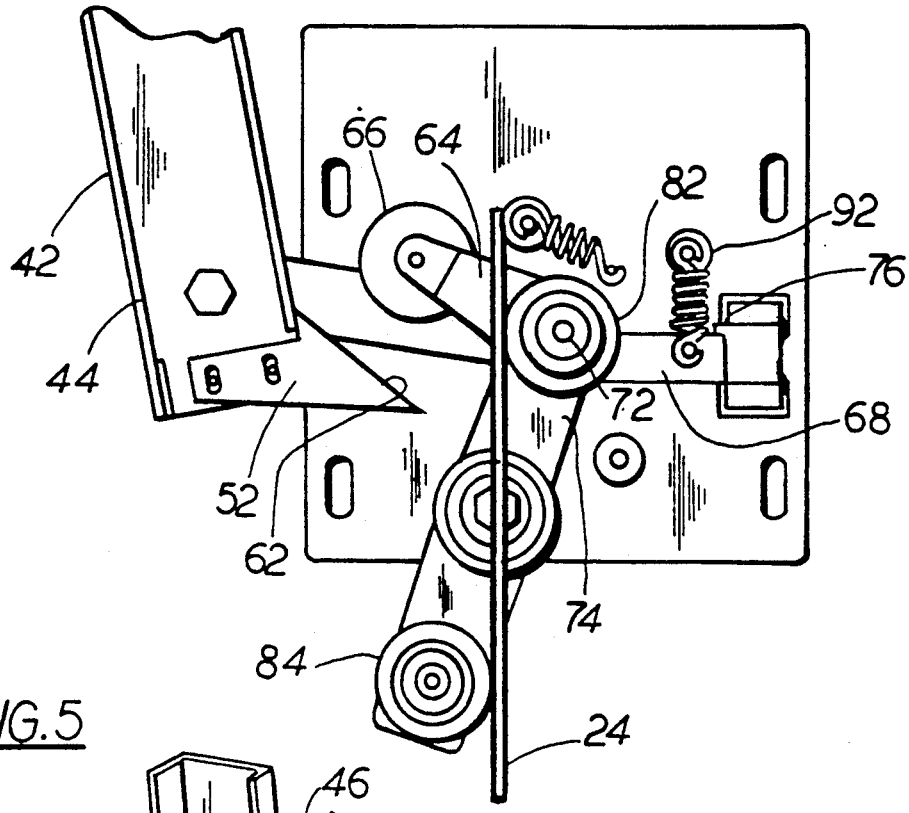
FIG. 4 shows a car and hoistway door coupling device of FIG. 1 in a third position.
Figure 5:
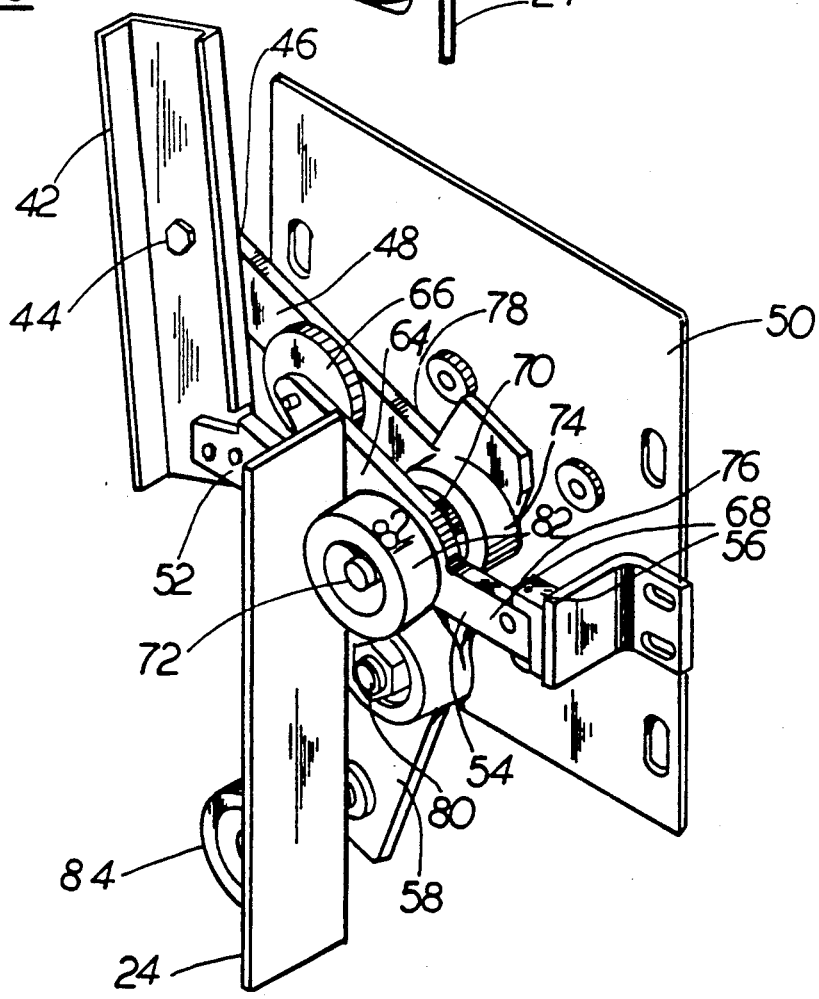
FIG. 5 is an exploded view of the car and hoistway door coupling device of FIG. 1.

Referring now to FIGS. 2–4, the operation of the coupling device is detailed. In FIG. 2, the doors 22 are fully closed. The latch plate 54 does not engage the latch 56. The second link 42 determines the position of the lever 58 by means of its connection via the third link 48. In this position, the second roller 82 and the third roller 84 are urged out of contact with the vane 24 and the elevator car 12 is therefore free to ascend or descend. The cam surface 62 engages the first roller 66 thereby urging the latch plate 54 to rotate clockwise to disengage the second leg 68 of the latch plate from the latch 56.

Referring to FIG. 3, as the door operating unit begins to operate, the second link 42, via its connection to the first link, rotates in a clockwise direction to the left as shown. The second link pulls the third link 48 which causes the lever 58 to rotate in a counterclockwise direction about the second axle 80. As the second link moves towards the left, the first roller 66 moves along the cam surface 62 and the second spring 92 pulls the second leg 68 of the latch plate upwardly towards engagement with the latch 56. As the lever rotates, the second and third rollers 82, 84 grip the vane 24 therebetween. Before the gripping of the vane by the second and third rollers there is minimal relative motion between the car and hoistway doors. It should be understood that if manufacturing tolerances are exact, there is no relative rotation between the car and hoistway doors.

Once the second and third rollers grip the vane, further motion of the door operating unit causes the car door and the hoistway door to move simultaneously. Essentially, the first ten degrees of sheave 14 rotation are used to urge the second and third rollers into contact with the vane.

Refer now to FIG. 4. The car door and the hoistway door (not shown) may open and close simultaneously. The cam surface 62 has moved away from the first roller 66 due to the motion of the third link 42. The second spring 92 has pulled the latch plate 54 into engagement with the latch 56. Each hoistway and car door closes simultaneously in this position because as the second link 42 moves to the right to close the door, the force of the motion is directed via the third link and the second arm of the latch plate against the latch. The latch prevents the lever from moving in a clockwise direction thereby preventing the second and third rollers 82, 84 from disengaging the vane 24 during the closing of the doors.

Referring back to FIG. 2, when the door is nearly closed, the cam surface 62 abuts the first roller 66 thereby causing the second leg 68 of the latch plate 54 to rotate in a clockwise direction to disengage the latch 56. The latch plate may include a roller (not shown) for contacting the latch to enable the latch plate to easily disengage the latch. Once the latch is disengaged, the lever is free to rotate via its connection with the third link 48 in a clockwise manner thereby disengaging the vane from the second and third rollers 82, 84. The elevator is then free to ascend or descend as the required running clearance is provided.

While the present invention has been illustrated and described with respect to a particularly preferred embodiment thereof, it will be appreciated by those skilled in the art that various other changes, omissions, and additions in the form and detail thereof may be made therein without departing from the spirit and scope of the invention. One of ordinary skill in the art will appreciate that the present invention may be utilized in other door systems than elevator door systems. Further, one of ordinary skill in the art will appreciate that means other than rollers may be utilized to grip the vane.

We claim:

1. A door coupler for connecting and disconnecting an inner door to an outer door, one of said inner and outer doors being driven by a linkage, the other of said inner and outer doors having means for attaching to said door coupler, said door coupler comprising;

a lever rotatably attached about a mid-portion thereof to one of said inner and outer doors, said lever having a first end portion and a second end portion each end portion having a means for engaging said means for attaching.

means for rotatably attaching one of said end portions of said lever to said linkage such that force of motion of the linkage causes the lever to rotate such that said means for engaging engages said means for attaching before motion of either of said inner or outer doors, a latch rotatably mounted about said one of said end portions of said lever, a catch fixedly attached to said one of said inner and outer doors for engaging said latch, and a cam attached to said linkage and engaging said latch such that said latch is positioned against said catch if said one of said inner or outer doors is opening or closing.

2. A door coupler for connecting and disconnecting an car door to a hoistway door, one of said car and hoistway doors being driven by a linkage, the other of said car and hoistway doors having means for attaching to said door coupler, said door coupler comprising;

a lever rotatably attached about a mid-portion thereof to one of said car and hoistway doors, said lever having a first end portion and a second end portion each end portion having a means for engaging said means for attaching, means for rotatably attaching one of said end portions of said lever to said linkage such that force of motion of the linkage causes the lever to rotate such that said means for engaging engages said means for attaching before motion of either of said car or hoistway doors, a latch rotatably mounted about said one of said end portions of said lever, a catch fixedly attached to said one of said car and hoistway doors for engaging said latch, and a cam attached to said linkage and engaging said latch such that said latch is positioned against said catch if said one of said car or hoistway doors is opening or closing.

* * * * *